United States Patent [19]

Lentz

[11] 4,368,563

[45] Jan. 18, 1983

[54] SEAT BELT BUCKLE WITH PLASTIC COVER

[75] Inventor: James M. Lentz, Knoxville, Tenn.

[73] Assignee: Allied Corporation, Morris Township, Morris County, N.J.

[21] Appl. No.: 282,697

[22] Filed: Jul. 13, 1981

[51] Int. Cl.[3] ..... A44B 11/26

[52] U.S. Cl. ..... 24/230 A

[58] Field of Search ..... 24/230 A, 230 AL, 230 AK, 24/230 AP

[56] References Cited

U.S. PATENT DOCUMENTS

| | | | |
|---|---|---|---|
| 3,605,209 | 9/1971 | Alarcon | 24/230 A |
| 3,790,994 | 2/1974 | Jakob | 24/230 A |
| 4,060,878 | 12/1977 | Dyki | 24/230 A |
| 4,128,924 | 12/1978 | Happel et al. | 24/230 AL |

FOREIGN PATENT DOCUMENTS

| | | | |
|---|---|---|---|
| 2729151 | 1/1978 | Fed. Rep. of Germany | 24/230 A |

*Primary Examiner*—Robert P. Swiatek
*Attorney, Agent, or Firm*—R. Criss

[57] ABSTRACT

A seat belt buckle assembly having a plastic cover and a plastic push button actuator. The underside of the cover is provided with three channels adjacent its forward end and a ledge which extends over part of the channels. The push button has three forwardly extending legs which are received in the channels of the cover to provide a pivot point for the button and limit lateral shifting.

10 Claims, 5 Drawing Figures

FIG. 1
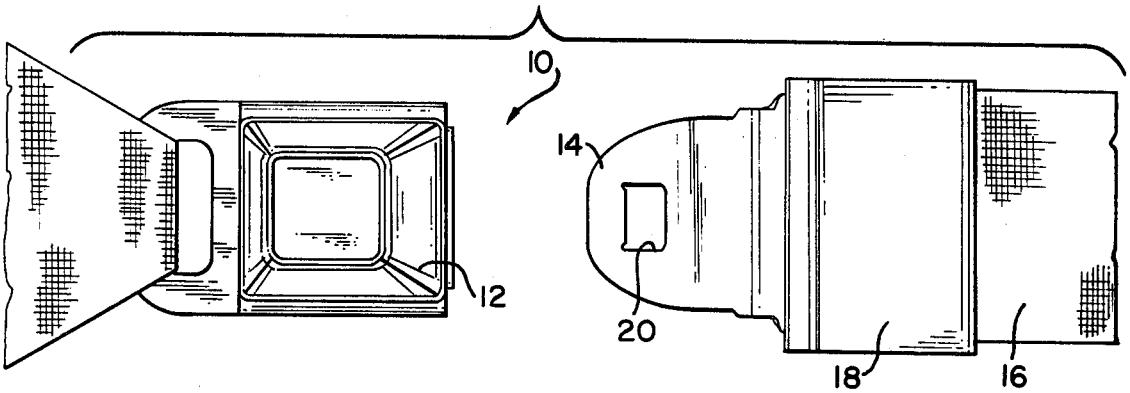
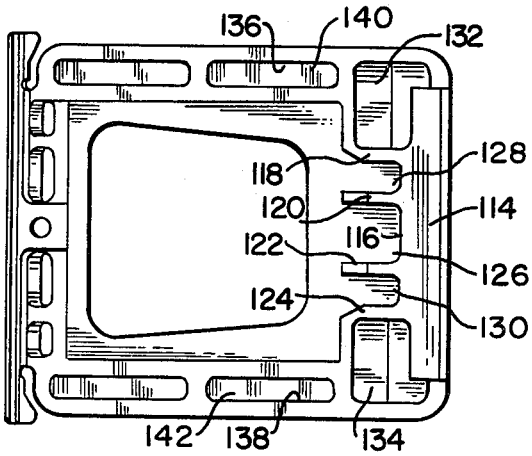
FIG. 3
FIG. 4
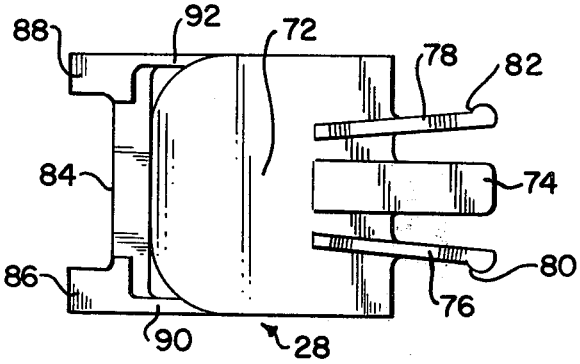
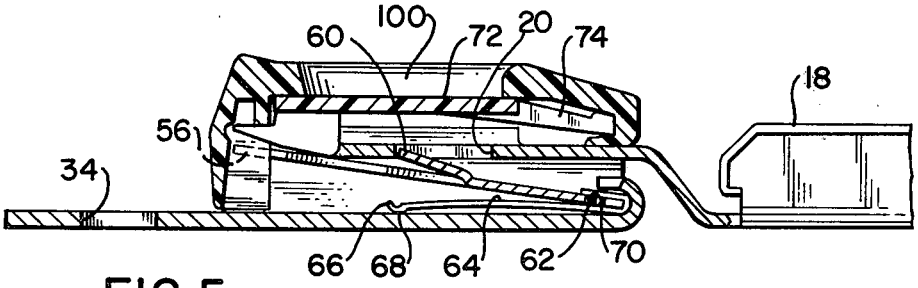
FIG. 5

SEAT BELT BUCKLE WITH PLASTIC COVER

DESCRIPTION

BACKGROUND OF THE INVENTION

1. Field of the Invention

This invention relates to seat belt buckles.

2. Description of the Prior Art

Seat belt buckles of the push button type have been used for some time in the United States. One type of buckle that has been extensively utilized is a low profile buckle having a stamped metal base, a spring loaded pivotable latch, a pivotable metal push button to actuate the latch and a stamped cover which snaps into the base and which has an inner fold at the forward portion of the buckle, with the push button being supported in such fold. The button includes two relatively thick side legs which are retained in the cover and a thinner central leg which acts as a spring against the cover. Such buckles are similar to those disclosed in U.S. Pat. Nos. 3,588,969 to Fisher and 3,331,108 to Fisher et al.

There are, however, some disadvantages to the prior buckle. The cover and push button are configured with several folded parts which makes them somewhat difficult to fabricate. Also, the cover and buckle are somewhat difficult to assemble since the forward end of the button must be fitted into the inner folds of the cover and then the assembly snapped over the base. During such operation, care must be taken that the button does not slip sideways or lengthwise. Moreover, due to the metal to metal contact between the button, the cover, and the latch, the buckle assembly is subject to rattling noise. Additionally, from an aesthetic standpoint it is difficult to provide the cover with a color so as to be coordinated with interior vehicle colors.

It would desirable if an improved buckle were provided in which the above problems were alleviated and which was also lighter in weight and less expensive.

SUMMARY OF THE INVENTION

In accordance with this invention, there is provided in a seat belt buckle comprising a base having upturned side shoulders, a latch pivotally supported in the base and contained between the side shoulders, the latch having a latching surface for communication with an opening in a tongue adapted to be inserted into the buckle, and a spring member biasing the latch into a latching position, the improvement comprising:

(1) an integral, one-piece molded plastic cover enclosing the base, latch and spring, the cover having molded therein a plurality of separate channels on the underside of the cover adjacent its forward end, each of the channels having an open end adjacent the central portion of the cover and a closed end adjacent the forward end of the cover, and integral ledge means extending adjacent the closed end of each of the channels, the cover having an aperture in its central portion; and (2) an integral, one-piece molded plastic push button having a central portion and a plurality of separate legs extending forwardly of the central portion, the legs extending into the separate channels on the underside of the cover, the ends of the legs being supported by the ledge means, the ends of the legs defining a pivot axis for the button, the legs being laterally retained in the channels to prevent lateral shifting of the button, the central portion of the button being positioned beneath the aperture in the cover whereby the button may be contacted and pivoted in the cover, and contact means on the underside of the button in contact with the latch.

Also in accordance with this invention, there is provided a cover and push button assembly for a seat belt buckle, the assembly comprising:

(1) an integral, one-piece molded plastic cover having molded therein three separate channels on the underside thereof adjacent its forward end, each of the channels having an open end adjacent the central portion of the cover and a closed end adjacent the forward end of the cover, and integral ledge means extending adjacent to the closed end of each of the channels, the cover having an aperture adjacent its central portion and a flange extending downwardly from the rear end of the cover; and (2) an integral, one-piece molded plastic push button having a central portion and three separate legs extending forwardly of the central portion, each of the legs extending into the respective channels on the underside of the cover, the ends of the legs being supported by the ledge means, the ends of the legs defining a pivot axis for the button, the legs being laterally retained in the channels to prevent lateral shifting of the button, the central portion of the button being positioned beneath the aperture in the cover whereby the button may be contacted and pivoted in said cover, and a pair of extensions extending rearwardly from the underside of the central portion of the button and being in contact with the inside of the flange whereby the button is retained longitudinally in the cover.

The present invention thus provides a plastic molded cover which has stiffening ribs to provide adequate crush resistance. At the front end of the cover, slots or recesses are provided to receive the pivoting legs of the push button which is also formed of molded plastic. The button has two compressible side legs which are compressed when received in the respective slots of the cover and which retain the button in the cover, preventing lateral movement of the button as well as rattling. The back end of the button has two extensions which abut against the back of the cover to retain the button in lengthwise position. The button also has ribs adjacent such rearward extensions which are engageable with the surfaces of a conventional latch to move the latch into release position. The forward end of the cover also is provided with lateral recesses which are adapted to engage upstanding fingers of the base to form a snap fit for the assembly.

Since the cover and button are formed of plastic which is preferably injection molded, a light weight, less expensive design is provided. The plastic may be molded in any desired color. The components may be readily fabricated, are easy to assemble and eliminate the rattling noise associated with the prior metal cover and button.

BRIEF DESCRIPTION OF THE DRAWINGS

FIG. 1 shows the buckle of the present invention in combination with a seat belt tongue.

FIG. 3 shows the underside of the cover of the buckle of this invention.

FIG. 4 shows the underside of the button of the buckle of this invention.

FIG. 5 is a cross-section view of the buckle with the tongue inserted in lock position.

DESCRIPTION OF THE PREFERRED EMBODIMENTS

Figure 2:
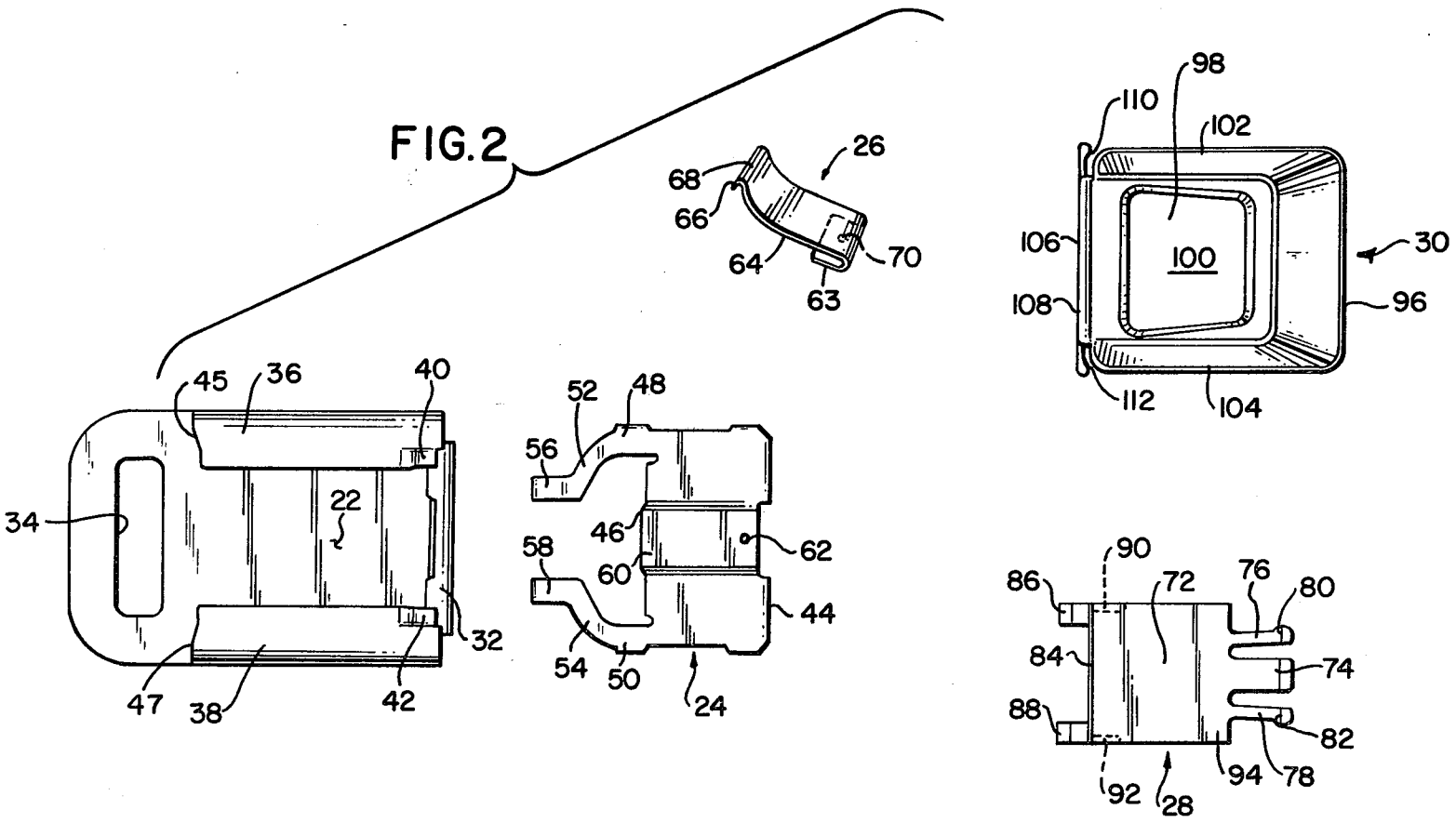
FIG. 2 shows an exploded view of the buckle of this invention.

With reference to FIG. 1, there is shown a buckle and tongue assembly generally indicated at 10, which includes a buckle 12 and a tongue 14 which is adapted to be inserted into the buckle. Tongue 14 is connected to seat belt 16 by any conventional means. As shown, the rear portion of tongue 14 includes a housing 18 which houses an adjust bar (not shown) about which seat belt 16 is looped. Alternatively, the seat belt may be directly attached to the tongue without an adjust bar. A central opening 20 is provided in tongue 14 to receive the latch of buckle 12.

Buckle 12 includes a base portion 22, latch 24, latch spring 26, push button 28 and cover 30. Base 22, latch 24 and latch spring 26 are each of conventional design. Base 22 is formed of metal and has a reentrant fold 32 adjacent its forward end and a slot 34 at its back end for receipt of webbing or other means to fasten buckle 12 to the vehicle structure. The sides of base 22 are folded over at 36, 38 in the form of shoulders to provide a channel for receipt of tongue 14. Tang members 40, 42 are formed on the front ends of shoulders 36, 38 and extend upwardly therefrom. Tangs 40, 42 are adapted to engage recesses in the bottom of cover 30. Rearward tab portions 45, 47 of shoulders 36, 38 provide lateral surfaces for engagement by the rearward portion of cover 30.

Latch 24 is a stamped metal part which has a forward edge 44, an intermediate edge 46 and two rearwardly extending legs 48, 50 that are curved inwardly at 52, 54 and then extend rearwardly at 56, 58. A latching face 60 extends upwardly from the plane of latch 24 adjacent edge 46 and is adapted for engagement with the edge of aperture 20 of tongue 14. An opening 62 is provided at the central portion of latch 24 adjacent edge 44 for retaining spring 26. Forward edge 44 of latch 24 is adapted to be retained in reentrant fold 32 of the base and is pivotable therein.

Latch spring 26 has a general L-shape with an end 63 bent upwards from central portion 64 which is curved to provide a spring bias. The opposite end 66 is curved upwards to define an edge 68 which bears against base 22. A detent 70 is provided adjacent end 63 to be received in opening 62 of latch 24 to retain spring 26 on latch 24.

In accordance with the present invention, a plastic button 28 is provided to actuate latch 24. Button 28 is preferably formed of a suitable material, such as nylon, polystyrene, polycarbonate or acrylonitrile-butadiene-styrene and may be glass filled to provide additional strength. Button 28 may be formed by injection molding, for example, and is a one-piece molded article. Button 28 has a central portion 72 with three legs extending forwardly of the central portion. Central leg 74 provides the main pivoting support for button 28 and side legs 76, 78, which are narrower than central leg 74 serve to retain button 28 in cover 30. Side legs 76, 78 extend outwardly at an angle with respect to central leg 74 and are compressible towards the central leg to retain the button in the cover. Side legs 76, 78 have hook-like extensions 80, 82 adjacent their distal ends for contact with the cover. Legs 74, 76 and 78 extend downwardly at an angle from central portion 72. Rear edge 84 of button 28 extends downwardly at about a right angle and supports rearward extensions 86, 88. Extensions 86, 88 are integral with ribs 90, 92 formed at the lateral edges of button 28. The upper surface 94 of button 28 may be provided with a decoration if desired.

Also in accordance with the present invention, a plastic cover 30 is provided. Cover 30 has a forward edge 96, which slopes downwards from a central portion 98 that defines an opening 100 through which the central portion 72 of the button may be contacted. Sides 102, 104 also slope downwards from opening 100. Extending downwardly from rear edge 106 of the cover is a flange 108 having lateral recesses 110, 112. Flange 108 serves to form the rearward wall of the buckle assembly and is adapted to snap over the rearward edges of base sides 36, 38 with the sides extending into the cutouts. Cover 30 is also preferably formed by injection molding, for example, from a suitable plastic material, such as polypropylene or polycarbonate, and also may be glass filled.

A section 114 extends downwardly adjacent forward edge 96 and has a back edge 116. Ribs 118, 120, 122 and 124 extend rearwardly from edge 116 to define a central channel 126 and narrower side channels 128, 130. The forward ends of these channels extend beyond edge 116 of section 114. Central channel 126 is adapted to receive central leg 74 of button 28 and side channels 128, 130 receive side legs 76, 78. The ends of each of the legs extend adjacent the ends of their respective channels so as to be retained by the overlying lip or ledge. Hooks 80, 82 are pressed against the inner walls of ribs 118, 124 to press fit the button in the cover and to provide a pivot axis for the button.

Extending laterally of ribs 118, 124 are recesses 132, 134 formed in the underside of the button and which are adapted to guide and receive tangs 40, 42 of base 22. Section 114 terminates laterally short of the side edges of cover 30, with the side edges of section 114 adapted to fit between the edges of sides 36, 38 adjacent tangs 40, 42. Portions 136, 138 of the underside of cover 30 adjacent its sides are preferably cored out at 140, 142 to reduce the amount of material required.

To assemble the button and cover assembly, the button is inserted into the cover from the bottom, with legs 74, 76 and 78 inserted into the respective channels 126, 128 and 130. Side legs 76 and 78 are compressed against the walls of the channels and act to retain the button in the cover and provide the pivot axis at hooks 80, 82. The button is then pressed downwardly to cover aperture 100 in cover 30, with extensions 86, 88 of the button being pressed against the inner surface of flange 108. As a result, button 28 is prevented from sliding longitudinally in cover 30. Button 28 is prevented from shifting laterally due to the contact of the legs in the channels. Button 28 is pivoted adjacent its forward end on legs 74, 76 and 78, with the pivot axis being defined by the edges of hooks 80, 82 and contact with the inner walls of ribs 118, 124, as well as the underneath portion of legs 74, 76 and 78 bearing against the ledge formed by rear edge 116 of section 114. To complete the assembly of the buckle, spring 26 is snapped over latch 24 which is then inserted under shoulders 36, 38 until the forward edge 44 is within the reentrant fold 32. The cover and button assembly is then placed over the front portion of the base assembly, with the tangs 40, 42 extending into recesses 132, 134 of the cover. The back end of the cover and buckle assembly is then snapped over the back end of the base.

Operation of the buckle is effected in a conventional manner. As tongue 14 is inserted into the buckle housing, latch face 60 is depressed against the action of spring 26 until opening 20 in tongue 14 overlies latch face 60 at which time the latch is urged upwardly by spring 26 to engage opening 20. To release the tongue, the user presses down the central portion 98 of button 28. This results in a pivoting action along the front of legs 74, 76 and 78 of button 28, resulting in a downward movement of latch 24 due to the contact of ribs 90, 92 of button 28 on the straight portions 56, 58 of legs 48, 50 of latch 24. When latch 24 is sufficiently pressed downwards, latch face 60 is depressed beneath the plane of tongue 14 and out of tongue opening 20, whereby the tongue is released.

It can thus be seen that the present invention provides a lightweight plastic cover and button assembly for a seat belt buckle in which integral channels in the cover serve to limit lateral shifting of the button legs and also form ribs which provide crush resistance for the assembly. Furthermore, rattling associated with the prior metal buckle cover and button is eliminated.

It is to be understood that variations and modifications of the present invention may be made without departing from the scope thereof. It is also to be understood that the present invention is not to be limited by the specific embodiments disclosed herein but only in accordance with the appended claims when read in light of the foregoing specification.

I claim:

1. In a seat belt buckle comprising a base having upturned side shoulders, a latch pivotally supported in said base and contained between said side shoulders, said latch having a latching surface for communication with an opening in a tongue adapted to be inserted into said buckle, and a spring member biasing said latch into a latching position, the improvement comprising:

(1) an integral, one-piece molded plastic cover enclosing said base, latch and spring, said cover having molded therein a plurality of separate channels on the underside of said cover adjacent its forward end, each of said channels having an open end adjacent the central portion of said cover and a closed end adjacent said forward end of said cover, and integral ledge means extending adjacent the closed end of each of said channels, said cover having an aperture in its central portion; and (2) an integral, one-piece molded plastic push button having a central portion and a plurality of separate legs extending forwardly of said central portion, said legs extending into said separate channels on the underside of said cover, the ends of said legs being supported by said ledge means, the ends of said legs defining a pivot axis for said button, said legs being laterally retained in said channels to prevent lateral shifting of said button, said central portion of said button being positioned beneath said aperture in said cover whereby said button may be contacted and pivoted in said cover, and contact means on the underside of said button in contact with said latch.

2. The seat belt buckle of claim 1 including recesses in the underside of said cover laterally spaced from said channels and adjacent said forward end of said cover, said side shoulders having locking tabs extending therefrom adjacent the forward end of said base, said locking tabs being received in and retained in said recesses.

3. The seat belt buckle of claim 2 wherein said button comprises a central leg and two side legs having a width less than said central leg, and said cover comprises a central channel receiving said central leg and two side channels receiving said side legs, said side channels having a width less than said central channel.

4. The seat belt buckle of claim 3 including lateral extensions of said side legs of said button, said lateral extensions being in contact with the lateral edges of said side channels, said lateral extensions providing the pivot axis for said button.

5. The seat belt buckle of claim 4 wherein said channels are defined by four spaced ribs extending rearwardly from the forward edge of said cover, and said ledge means comprises a rearward substantially flat extension of the front edge of said cover.

6. The seat belt buckle of claim 5 wherein said ledge means extends laterally of said ribs into said recesses, said locking tabs of said base being retained in said ledge means.

7. The seat belt buckle of claim 3 including a pair of extensions extending rearwardly from the underside of the central portion of said button, said rearward extensions being in communication with ribs extending downwardly from said central portion of said button, said downwardly extending ribs defining said contact means, and said cover including a flange extending downwardly from the rear end of said cover, said extensions on said button being in contact with the inside of said flange whereby said button is retained longitudinally in said cover.

8. A cover and push button assembly for a seat belt buckle, said assembly comprising:

(1) an integral, one-piece molded plastic cover having molded therein three separate channels on the underside thereof adjacent its forward end, each of said channels having an open end adjacent the central portion of said cover and a closed end adjacent said forward end of said cover, and integral ledge means extending adjacent to said closed end of each of said channels, said cover having an aperture in its central portion and a flange extending downwardly from the rear end of said cover; and (2) an integral, one-piece molded plastic push button having a central portion and three separate legs extending forwardly of said central portion, each of said legs extending into said separate channels on the underside of said cover, the ends of said legs being supported by said ledge means, the ends of said legs defining a pivot axis for said button, said legs being laterally retained in said channels to prevent lateral shifting of said button, said central portion of said button being positioned beneath said aperture in said cover whereby said button may be contacted and pivoted in said cover, and a pair of extensions extending rearwardly from the underside of said central portion of said button, said rearward extensions being in contact with the inside of said flange of said cover whereby said button is retained longitudinally in said cover.

9. The cover and push button assembly of claim 8 including lateral extensions of the side legs of said button, said side legs being narrower than the central leg of said button, said lateral extensions being in contact with the lateral edges of the side channels, said side channels of said cover being narrower than the central channel of said cover, said lateral extensions providing the pivot axis for said cover.

10. The cover and push button assembly of claim 9 including recesses in the underside of said cover laterally spaced from said channels and adjacent said forward end of said cover, said ledge means extending laterally of said channels into said recesses, and ribs extending downwardly from said central portion of said button, said downwardly extending ribs defining contact means and being in communication with said rearward extensions of said button.

* * * * *